US006786322B2

(12) United States Patent
Pellicer Thoma

(10) Patent No.: US 6,786,322 B2
(45) Date of Patent: Sep. 7, 2004

(54) COOLING TUNNEL FOR FLEXIBLE PACKAGES FILLED WITH HOT LIQUID PRODUCTS

(75) Inventor: Ramon Pellicer Thoma, Caldes de Montbui (ES)

(73) Assignee: Volpak, S.A., Santa Perpetua de Mogoda (ES)

( * ) Notice: Subject to any disclaimer, the term of this patent is extended or adjusted under 35 U.S.C. 154(b) by 0 days.

(21) Appl. No.: 10/367,937

(22) Filed: Feb. 19, 2003

(65) Prior Publication Data

US 2003/0155032 A1 Aug. 21, 2003

(30) Foreign Application Priority Data

Feb. 20, 2002 (ES) ..... 200200403

(51) Int. Cl.[7] ..... B65G 47/26

(52) U.S. Cl. ..... 198/432; 198/426; 198/428; 198/952

(58) Field of Search ..... 198/426, 427, 198/428, 429, 431, 423, 952

(56) References Cited

U.S. PATENT DOCUMENTS 3,321,061 A * 5/1967 Huffman et al. ..... 198/426
4,344,523 A * 8/1982 May et al. ..... 198/426
4,718,535 A * 1/1988 Wolff ..... 198/428
5,133,446 A * 7/1992 Draghetti ..... 198/429
5,799,770 A * 9/1998 Radewagen ..... 198/432
6,082,523 A * 7/2000 Weeks ..... 198/432
6,223,884 B1 * 5/2001 Ronchi ..... 198/431

FOREIGN PATENT DOCUMENTS

DE 2408158 * 8/1975 ..... 198/426
FR 2607481 * 6/1988 ..... 198/426

* cited by examiner

*Primary Examiner*—James R. Bidwell
(74) *Attorney, Agent, or Firm*—Sughrue Mion, PLLC

(57) ABSTRACT

Cooling tunnel for flexible packages filled with hot liquid products. The cooling tunnel is applicable to automatic packaging installations and comprises a main conveyor belt (1) adapted for the transport of packages (2) filled with hot liquid products through a cooling device (3), loading means (4) of packages (2) onto the main conveyor belt (1), unloading means (5) of packages (2) from the conveyor belt (1) and emptying means (6) of the packages (2). The loading means (4) are adapted for loading the packages (2) onto the main conveyor belt (1) forming successive sets (15), in which the packages (2) form an arrangement of orthogonal rows and columns, whereas the unloading means (5) are adapted for the simultaneous unloading of the packages (2) from each row of the sets (15) of packages (2).

6 Claims, 3 Drawing Sheets

COOLING TUNNEL FOR FLEXIBLE PACKAGES FILLED WITH HOT LIQUID PRODUCTS

TECHNICAL SECTOR OF THE INVENTION

The object of the invention is a cooling tunnel for flexible packages filled with hot liquid products, such as hot-fill, packaged beverages.

BACKGROUND TO THE INVENTION

Embodiments of cooling tunnels for packages filled with hot liquid products are known, wherein the liquid is packaged at a high temperature for the purpose of sterilizing the container itself and those components of which it is made up, such as, for example, straws and closing elements. The cooling tunnels for packages containing hot liquid products form part of the packaging installations and are arranged on the production line next to the packaging line. In summary, the cooling tunnel embodiments comprise loading means of the packages in the tunnel, transport means of the packages through the tunnel, cooling means of the packages on their path through the tunnel and collection means of the packages once cooled.

The main drawback of the known embodiments of the cooling tunnels like those described earlier is the high cost and size of the means used for the transport, loading and unloading of the packages in the cooling tunnel and basically, as a consequence of the flexible nature of the package, it prevents their piling up and is largely responsible for making their handling difficult, requiring, for example, the use of individual mobile containers linked to conveying gears, adapted for transporting the filled packages.

EXPLANATION OF THE INVENTION

The cooling tunnel for packages filled with hot liquid products object of the invention, is applicable to automatic packaging installations of the type comprising a main conveyor belt for conveying the filled packages through a cooling device which extends throughout the tunnel; loading means of the filled packages onto the main conveyor belt; and unloading means of the filled packages from the main conveyor belt.

The cooling tunnel object of the invention is characterised in that the loading means of the packages are adapted for loading the packages onto the main conveyor belt at its starting end portion, forming sets that succeed one another, the packages of each set forming an arrangement in orthogonal rows and columns, in which the rows are arranged transversally with regard to the main conveyor belt; and in that the unloading means are adapted for simultaneously unloading the packages of each row that reaches the end point of the main conveyor belt.

According to another feature of the cooling tunnel of the invention, the loading means comprise a first conveyor belt for packages, adapted for receiving at its starting end, groups of packages arranged parallel to it and with their bottom positioned in the advancing direction of the conveyor belt, equal in number to the rows in each set of packages to be loaded onto the main conveyor belt; a package alignment device, arranged at the end point of the first conveyor belt, adapted for aligning the packages of each group of packages by their bottoms; a second conveyor belt of packages arranged coplanar, adjoining and in longitudinal alignment with respect to the first conveyor belt, and also arranged coplanar, adjoining and transversal with regard to the main conveyor belt, adapted for receiving at its starting end the groups of packages aligned by the alignment device and for forming the sets of packages to be loaded onto the main conveyor belt; and a transfer device, adapted for transferring the sets of packages from the second conveyor belt to the main conveyor belt.

It is also a feature of the cooling tunnel according to the invention that the first conveyor belt has a transport speed V, whereas the second conveyor belt has a first transport speed V1 equal to the transport speed V of the first conveyor belt, and a second transport speed V2, greater then V1, adapted so that the speeds V and V1 of the first conveyor belt and of the second conveyor belt, respectively, permit the formation on the second conveyor belt of a set of packages to be transferred to the main conveyor belt, whereas the speed V2 of the second conveyor belt makes it possible to create an interval between successive sets of packages to be transferred.

Another feature of the invention consists of the fact that the alignment device is arranged transversally with regard to the first conveyor belt and is capable of moving between two positions, a package alignment position, in which the packages from each group successively reach the device, and a passing position, in which the aligned packages from each group reach the starting end of the second conveyor belt.

In accordance with another feature of the invention, the transfer device comprises a transfer body provided with independent slots, adapted for receiving corresponding rows of packages from each set of packages to be loaded onto the main conveyor belt, each slot being provided with an inlet, adapted for allowing the packages from the row to pass through, and with an open bottom.

The invention is also characterised in that the transfer body is capable of sequential movement from among four positions, a first position in which the transfer body is superimposed onto the second conveyor belt, a second position, coplanar to the previous transfer one of the set of packages to the main conveyor belt, a third position, superimposed onto the second position and a fourth position, coplanar to the third position and superimposed onto the first position.

According to another feature of the invention, the unloading means comprise a shaft arranged transversally with regard to the main conveyor belt and capable of rotating in both directions, provided with a plurality of radial blades, adapted for receiving a row of packages and, by the rotation of the shaft, deposit it into the package emptying means.

BRIEF DESCRIPTION OF THE DRAWINGS

Illustrated in the attached drawings, by way of non-limiting example, is a mode of embodiment of the cooling tunnel for flexible packages filled with hot liquid products object of the invention. In said drawings.

DETAILED DESCRIPTION OF THE DRAWINGS

Figure 1:
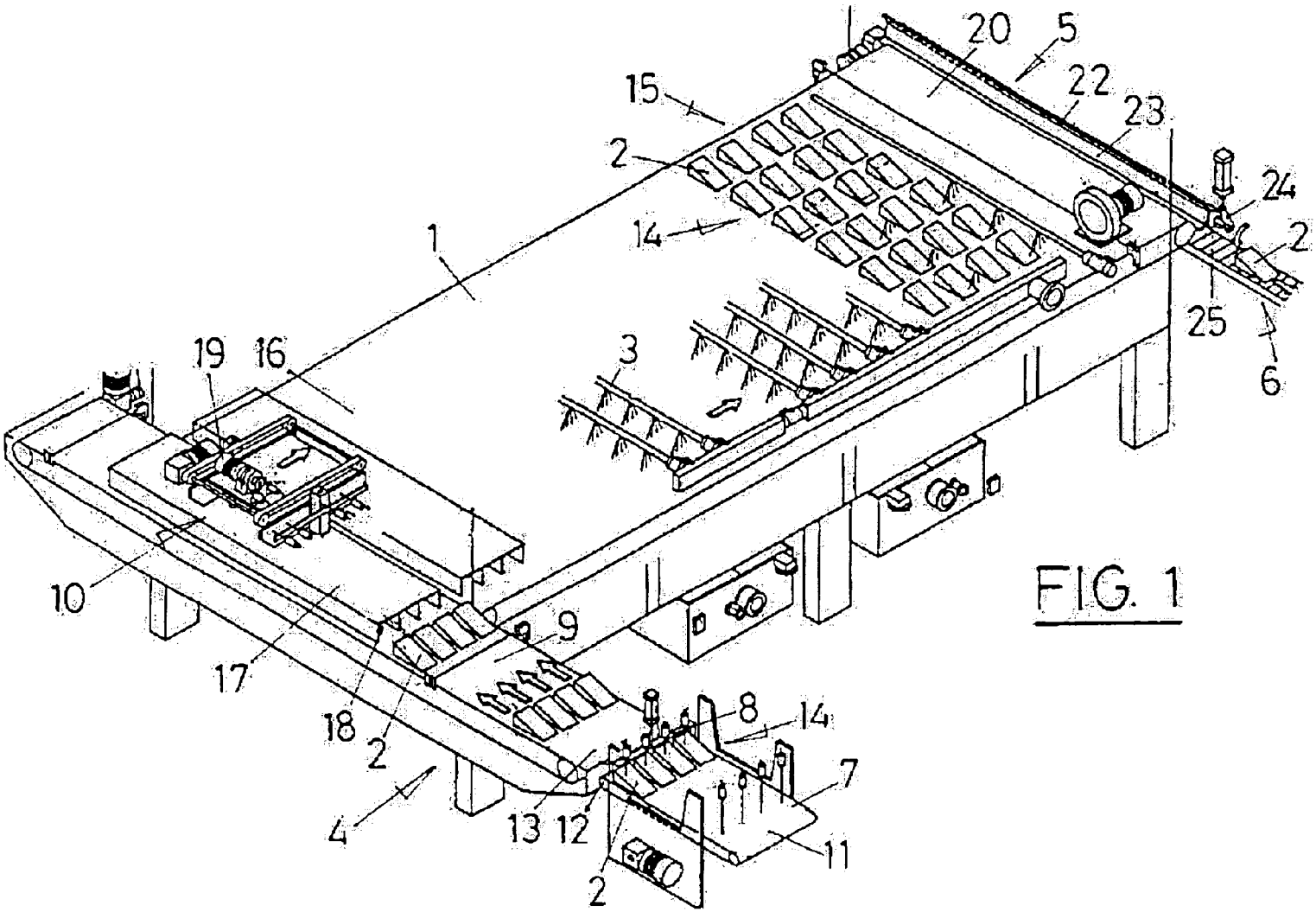
FIG. 1, is a diagrammatic perspective representation of a cooling tunnel according to the invention.

In FIG. 1 it can be appreciated that the cooling tunnel according to the invention comprises a main conveyor belt 1, adapted for conveying flexible packages 2, filled with a hot liquid product, below a cooling device 3 consisting of the projection of a cooling liquid, such as water, onto the packages 2, loading means 4 of the flexible packages 2 onto the main conveyor belt 1, unloading means 5 of packages 2 from the main conveyor belt 1, and emptying means 6 of cooled packages 2.

The loading means 4 comprise a first conveyor belt 7, an alignment device 8, a second conveyor belt 9 and a transfer device 10 of packages 2 from the second conveyor belt 9 to the main conveyor belt 1.

The first conveyor belt 7 is adapted for receiving at its starting end 11 successive groups 14 of packages 2, made up of four packages arranged parallel to the longitudinal shaft of the conveyor belt 7 and with their bottom positioned in the direction of conveyance. The groups 14 of packages 2 are supplied in said position by packaging gears not represented, it being highlighted at this point that the successive groups of packages may be made up of a different number of packages from that indicated, for example, five or more packages, without affecting the essence of the invention. The alignment device 8 is arranged at the end point 12 of the first conveyor belt 7, and is adapted for aligning by their bottom the packages 2 from each of the groups 14 of packages 2 transported by the first conveyor belt 7. The second conveyor belt 9 is arranged coplanar, adjoining and in longitudinal alignment with regard to the first conveyor belt 7, and coplanar, adjoining and transversal with regard to the main conveyor belt 1, as can be appreciated in FIGS. 1 to 5, the second conveyor belt 9 being adapted for receiving at its starting end 13 the groups of aligned packages 2 transversally delivered by the first conveyor belt 7. The first conveyor belt 7 works at a transport speed V, whereas the second conveyor belt 9 works alternatively at a first transport speed V1 and at a second transport speed V2, greater than V1; the first transport speed V1 makes it possible to form sets 15 of groups 14 of packages 2 on the second conveyor belt 9, each of the sets 15 in this embodiment example being made up of four rows and six columns of packages 2, whereas the second transport speed V2 makes it possible to create an interval between successive sets 15. The transfer device 10 is adapted for transferring the sets 15 of packages 2 from the second conveyor belt 9 to the starting end 16 of the main conveyor belt 1.

In FIGS. 1 to 5 it can be appreciated that the transfer device 10 comprises a transfer body 17 provided with three longitudinal slots 18, independent to one another and adapted for receiving a corresponding row of packages 2, the transfer body 17 being coupled to an activating mechanism 19 which gives it a sequential moving capability from among four positions which will be described later. In this embodiment example of the tunnel of the invention, wherein each set 15 of packages 2 is made up of four rows of packages 2, the transfer body 17 has three longitudinal slots 18, adapted for receiving corresponding rows of packages 2, the remaining row of packages 2 being arranged exterior to the transfer body 17, on the side adjacent to the main conveyor belt 1.

Figure 2:
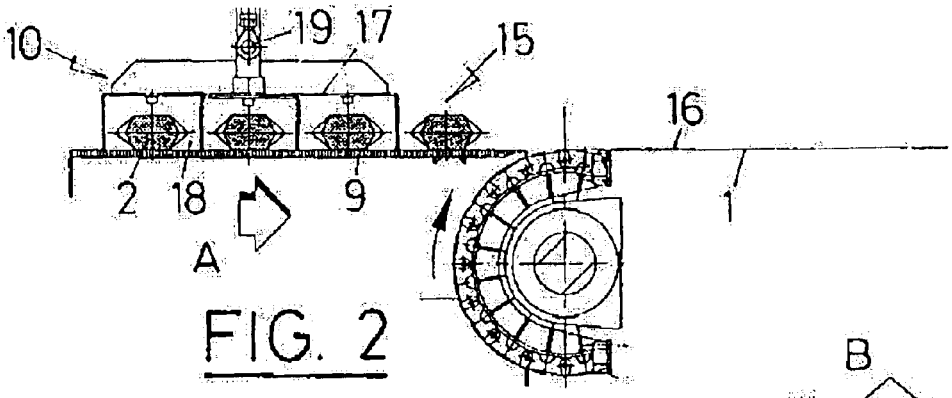
FIGS. 2, 3, 4 and 5, are respective diagrammatic transversal section views of the loading means of the cooling tunnel according to the invention, corresponding to successive phases of the loading operations of the packages onto the tunnel main conveyor belt.
Figure 3:
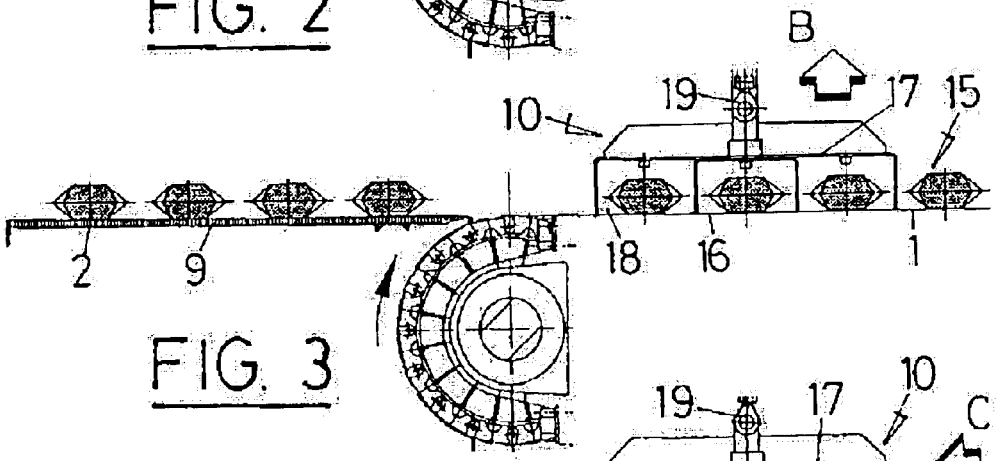
Figure 4:
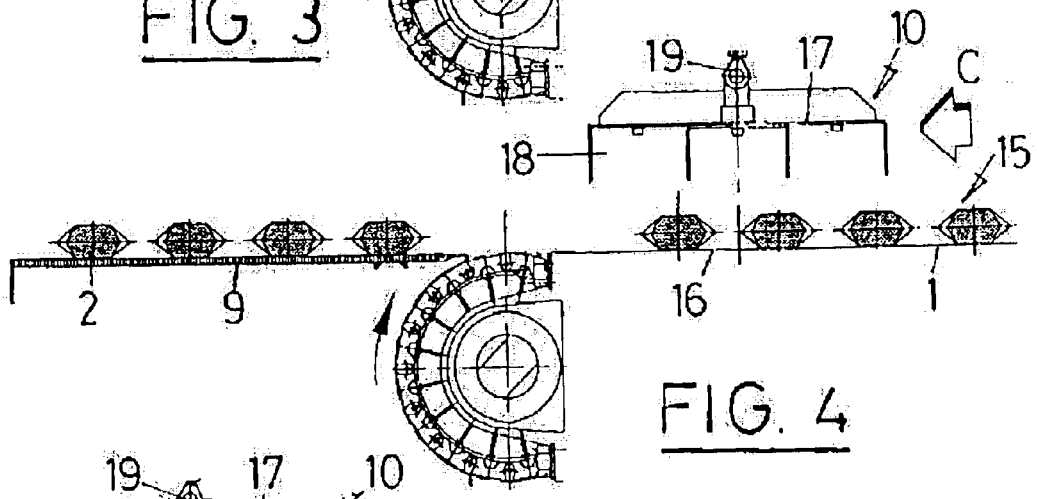
Figure 5:
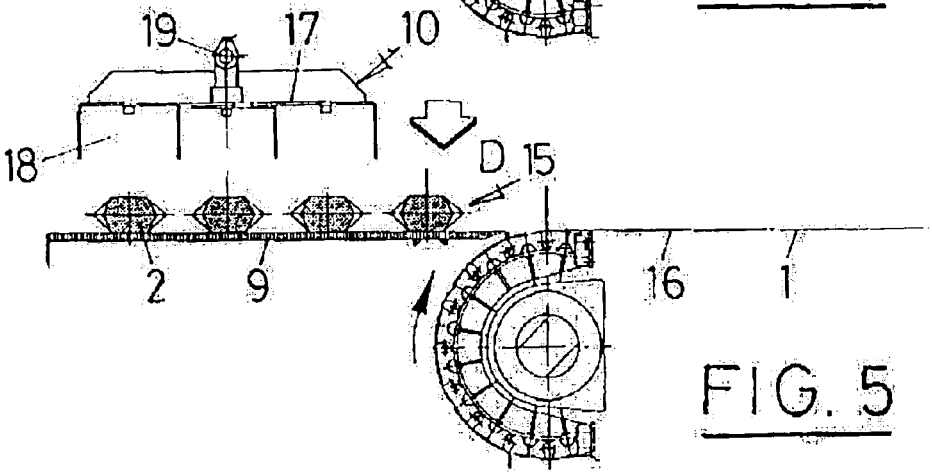

The operation of the transfer device 10 is described next with the help of FIGS. 2 to 5. In FIG. 2, the transfer body 17 occupies a first position superimposed onto the second conveyor belt 9, there being arranged in the three slots 18 three corresponding rows of packages 2 and exterior to the transfer body 17 the remaining row of packages 2, the four rows of packages 2 constituting the set 15 of packages 2 to be transferred to the main conveyor belt 1. In FIG. 3, the transfer body 17 occupies a second position driven by the activating mechanism 19 in the horizontal direction indicated as A in FIG. 2, said second position being coplanar with the first position detailed in FIG. 1 and which positions the set 15 of packages 2 at the starting end 16 of the main conveyor belt 1 by sliding the set 15 of packages 2 from one belt to the other. In FIG. 4, the transfer body 17 occupies a third position driven by the activating mechanism 19 in the ascending direction indicated as B in FIG. 3, in which it is superimposed on the previous position detailed in FIG. 3. In FIG. 5, the transfer body 17 occupies a fourth position driven by the activating mechanism 19 in the horizontal direction indicated as C in FIG. 4, in which it is superimposed onto the first position detailed in FIG. 2; the movement of the transfer body 17 in the descending direction indicated as D in FIG. 5 places it in the initial position of FIG. 1, ready to proceed to the transfer of another set 15 of packages 2.

Figure 8:
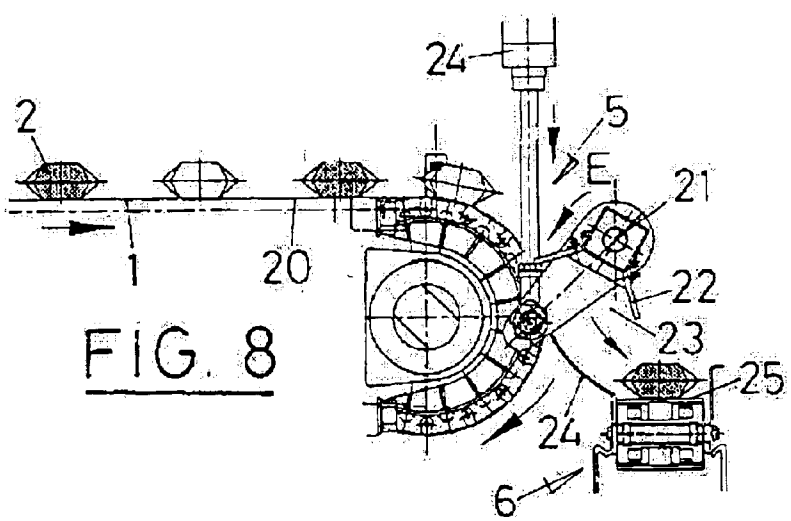
FIGS. 6, 7, 8 and 9, are respective diagrammatic transversal section views of the unloading means of the cooling tunnel according to the invention, corresponding to successive phases of the loading operations of the packages from the main conveyor belt.
Figure 9:
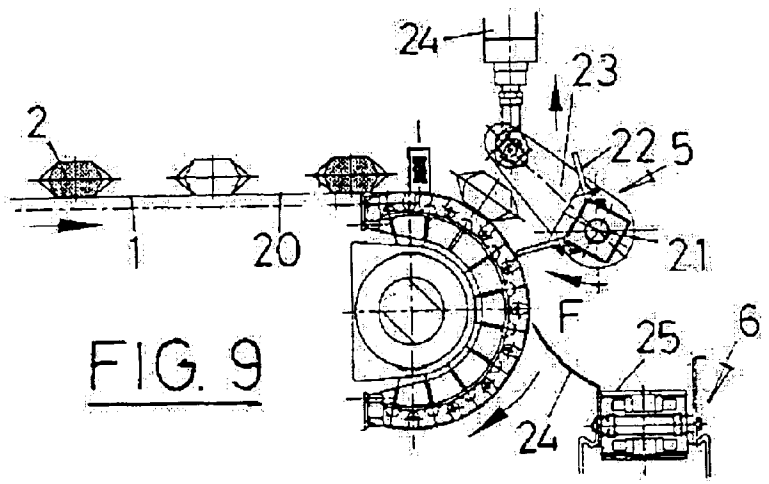

In FIG. 1 it can be appreciated that the unloading means 5 of packages 2 are located at the end point 20 of the main conveyor belt 1 and comprise a shaft 21, arranged transversally and parallel to the main conveyor belt 1 and with the capacity to rotate in both directions, indicated as E and F in FIGS. 8 and 9 respectively. Coupled to the shaft 21 are two radial blades 22 which configure a longitudinal slot 23, adapted for receiving a row of packages 2, coming from the end point 20 of the main conveyor belt 1, and an activating mechanism 24 adapted for producing the rotating of the shaft 21 in both directions E and F.

In FIGS. 1 and 6 to 9 it is appreciated that the evacuation means 6 of packages 2 comprise an unloading ramp 24 and a conveyor belt 25 for the evacuation of packages 2. Both elements, unloading ramp 24 and conveyor belt 25, extend along the longitudinal slot 26 of the shaft 21 of the unloading means 5.

Figure 6:
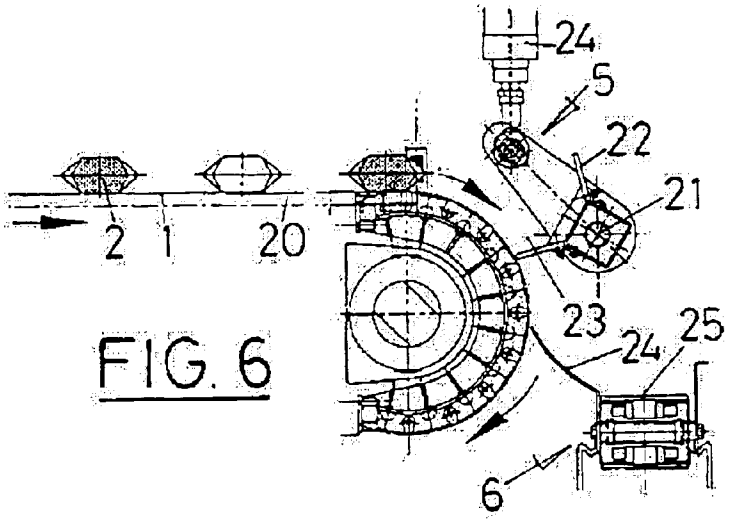
Figure 7:
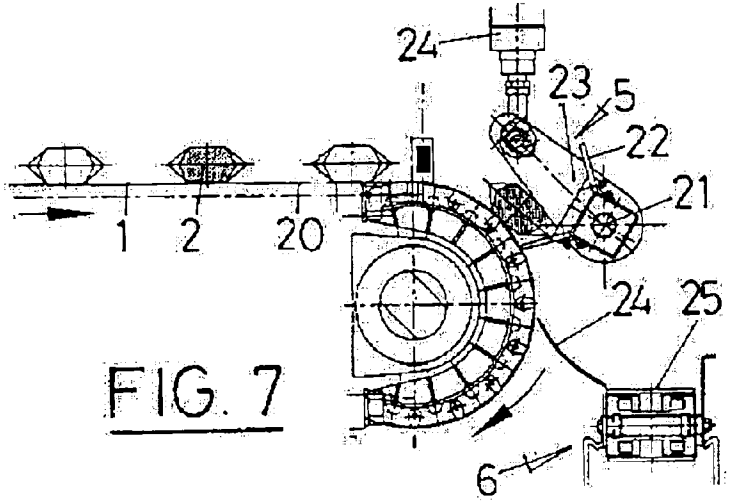

The operating of the unloading means 5 of packages 2 is described next with the help of FIGS. 6 to 9. In FIG. 6, the longitudinal slot 23 occupies a first receiving position of a row of packages 2. In FIG. 7, the advancing of the main conveyor belt 1 causes, due to gravity, the falling of a row of packages 2 into the longitudinal slot 23. In FIG. 8, the rotating of the shaft 21 in direction E until it reaches a second position, causes, also because of gravity, the falling of the row of packages 2 contained in the longitudinal slot 23 and their sliding over the unloading ramp 24 onto the conveyor belt 25. Lastly, in FIG. 9, one rotation of the shaft 21 in the opposite direction to the earlier one, indicated as F, places the longitudinal slot 23 in the first position, ready for receiving a new row of packages 2.

What is claimed is:

1. Cooling tunnel for packages filled with hot liquid products, applicable to automatic packaging installations comprising:

a main conveyor belt for conveying the filled packages through a cooling device which extends throughout the tunnel;

a loading means for loading the filled packages onto the main conveyor belt; and an unloading means for unloading filled packages from the main conveyor belt;

wherein the loading means of the packages are adapted for loading the packages onto the main conveyor belt at its starting end portion, forming sets that succeed one another, the packages of each set forming an arrangement in orthogonal rows and columns, in which the rows are arranged transversally with regard to the main conveyor belt;

wherein the unloading means are adapted for simultaneously unloading the packages of each row that reaches the end point of the main conveyor belt; and, wherein the loading means comprise:

a first conveyor belt for conveying packages, adapted for receiving at its starting end, groups of packages arranged parallel to the starting end and with their bottom positioned in the advancing direction of the first conveyor belt, equal in number to the rows in each set of packages to be loaded onto the main conveyor belt;

a package alignment device, arranged at the end point of the first conveyor belt, adapted for aligning the packages of each set of packages by their bottoms;

a second conveyor belt of packages arranged coplanar, adjoining and in longitudinal alignment with respect to the first conveyor belt, and also arranged coplanar, adjoining and transversal with regard to the main conveyor belt, adapted for receiving at its starting end the groups of packages aligned by the alignment device and for forming the sets of packages to be loaded onto the main conveyor belt; and a transfer device, adapted for transferring the sets of packages from the second conveyor belt to the main conveyor belt.

2. Cooling tunnel according to claim 1, wherein the first conveyor belt has a transport speed V, whereas the second conveyor belt has a first transport speed V1 equal to the transport speed V of the first conveyor belt, and a second transport speed V2, greater than V1, adapted so that the speeds V and V1 of the first conveyor belt and of the second conveyor belt, respectively, permit the formation on the second conveyor belt of a set of packages to be transferred to the main conveyor belt, whereas the speed V2 of the second conveyor belt makes it possible to create an interval between successive sets of packages to be transferred.

3. Cooling tunnel according to claim 1, wherein the alignment device is arranged transversally with regard to the first conveyor belt and is capable of moving between two positions;

a package alignment position, in which the packages from each group successively reach the device, and a passing position, in which the aligned packages from each group reach the starting end of the second conveyor belt.

4. Cooling tunnel according to claim 1, wherein the transfer device comprises a transfer body provided with independent slots, adapted for receiving corresponding rows of packages from each set of packages to be loaded onto the main conveyor belt, each slot being provided with an inlet, adapted for allowing the packages from the row to pass through, and with an open bottom.

5. Cooling tunnel according to claim 4, wherein the transfer body is capable of sequential movement from among four positions;

a first position in which the transfer body is superimposed onto the second conveyor belt, a second position, coplanar to the previous transfer one of the set of packages to the main conveyor belt, a third position, superimposed onto the second position, and a fourth position, coplanar to the third position and superimposed onto the first position.

6. Cooling tunnel according to claim 1, wherein the unloading means comprise a shaft arranged transversally with regard to the main conveyor belt and capable of rotating in both directions, provided with a plurality of radial blades, adapted for receiving a row of packages and, by the rotation of the shaft, deposit the row of packages into the package emptying means.

* * * * *